US008104110B2

(12) United States Patent
Caudill et al.

(10) Patent No.: US 8,104,110 B2
(45) Date of Patent: Jan. 31, 2012

(54) SPA SYSTEM WITH FLOW CONTROL FEATURE

(75) Inventors: Dirk A. Caudill, Yorba Linda, CA (US); Eric S. Cole, Corona, CA (US)

(73) Assignee: Gecko Alliance Group Inc., Québec, Québec (CA)

( * ) Notice: Subject to any disclaimer, the term of this patent is extended or adjusted under 35 U.S.C. 154(b) by 975 days.

(21) Appl. No.: 11/653,082

(22) Filed: Jan. 12, 2007

(65) Prior Publication Data

US 2008/0168599 A1 Jul. 17, 2008

(51) Int. Cl.
*A47K 3/00* (2006.01)

(52) U.S. Cl. ..... 4/541.1; 700/282

(58) Field of Classification Search ..... 4/541.1–541.6; 417/44.1, 42; 700/281, 282
See application file for complete search history.

(56) References Cited

U.S. PATENT DOCUMENTS

| | | | | |
|---|---|---|---|---|
| 4,330,412 | A | 5/1982 | Frederick | |
| 4,397,610 | A | 8/1983 | Krohn | 417/44 |
| 4,686,439 | A | 8/1987 | Cunningham et al. | 318/335 |
| 4,756,030 | A * | 7/1988 | Juliver | 4/668 |
| 4,853,987 | A | 8/1989 | Jaworski | |
| 4,924,069 | A | 5/1990 | Giordani | |
| 4,998,865 | A | 3/1991 | Nakanishi et al. | 417/423.7 |
| 5,058,804 | A * | 10/1991 | Yonekubo et al. | 236/12.12 |
| 5,151,017 | A | 9/1992 | Sears et al. | 417/45 |
| 5,156,535 | A | 10/1992 | Budris et al. | 417/423.7 |
| 5,172,754 | A | 12/1992 | Graber et al. | 165/47 |
| 5,245,714 | A * | 9/1993 | Haraga et al. | 4/541.2 |
| 5,457,826 | A * | 10/1995 | Haraga et al. | 4/541.4 |

(Continued)

FOREIGN PATENT DOCUMENTS

JP 11101193 4/1999

(Continued)

OTHER PUBLICATIONS

Office Action mailed on May 11, 2011 in connection with U.S. Appl. No. 12/914,369, 16 pages.

(Continued)

*Primary Examiner* — Gregory Huson
*Assistant Examiner* — Janie Christiansen

(57) ABSTRACT

A water circulating system, such as a spa system, is disclosed having a flow control feature. In one embodiment, the spa system includes a tub, a pump assembly and a controller. The pump assembly includes a BLDC motor and circulates water from the tub's outlet port to its inlet port. The controller sets the speed of the BLDC motor to any speed within the speed range of the BLDC motor in response to a user input to adjust the flow rate of the water to the inlet port of the tub. The spa system may also produce at least one jetting mode in response to a user input. The jetting mode may be a pulse mode, a sinusoidal mode, a ramp mode, or a saw-tooth mode. In another spa system, a first pump operates at a first speed to heat the circulating water when a heater is activated, and at a second speed when the heater is not activated. In other embodiments, the spa system includes a jetting pump assembly that includes a BLDC motor and a circulating pump assembly that operates at two speeds. In another embodiment, the spa system includes a circulating pump assembly that circulates water from an outlet port to an inlet port during standby. Where the circulating pump assembly operates at a first speed when a heater is activated to heat the circulating water, and at a second speed when the heater is not activated.

15 Claims, 5 Drawing Sheets

U.S. PATENT DOCUMENTS

| | | | | |
|---|---|---|---|---|
| 5,526,538 | A | 6/1996 | Rainwater | |
| 5,548,854 | A * | 8/1996 | Bloemer et al. | 4/541.6 |
| 5,710,409 | A | 1/1998 | Schwarzbacker et al. | |
| 5,780,990 | A | 7/1998 | Weber | 318/807 |
| 5,930,852 | A | 8/1999 | Gravatt et al. | |
| 6,003,166 | A | 12/1999 | Hald et al. | 417/32 |
| 6,200,108 | B1 | 3/2001 | Caudill et al. | |
| 6,206,036 | B1 | 3/2001 | Loyd et al. | 137/565.31 |
| 6,355,913 | B1 | 3/2002 | Authier et al. | |
| 6,412,123 | B1 | 7/2002 | Lau | 4/541.1 |
| 6,476,363 | B1 | 11/2002 | Authier et al. | |
| 6,488,408 | B1 | 12/2002 | Laflamme et al. | |
| 6,717,050 | B2 | 4/2004 | Laflamme et al. | |
| 6,744,223 | B2 | 6/2004 | Laflamme et al. | |
| 6,782,309 | B2 | 8/2004 | Laflamme et al. | |
| 6,813,575 | B2 | 11/2004 | Laflamme | |
| 6,874,175 | B2 | 4/2005 | Laflamme et al. | |
| 6,900,736 | B2 | 5/2005 | Crumb | |
| 6,929,516 | B2 | 8/2005 | Brochu et al. | |
| 6,942,354 | B2 | 9/2005 | Metayer et al. | |
| 6,943,325 | B2 | 9/2005 | Pettman et al. | 219/481 |
| 7,089,608 | B2 | 8/2006 | Erb | |
| 7,112,768 | B2 | 9/2006 | Brochu et al. | |
| 7,327,275 | B2 | 2/2008 | Brochu et al. | |
| 7,419,406 | B2 | 9/2008 | Brochu et al. | |
| 7,440,820 | B2 | 10/2008 | Gougerot et al. | |
| 7,489,986 | B1 | 2/2009 | Laflamme et al. | |
| 7,593,789 | B2 | 9/2009 | Gougerot et al. | |
| 7,619,181 | B2 | 11/2009 | Authier | |
| 7,701,679 | B2 | 4/2010 | Brochu et al. | |
| 7,843,357 | B2 | 11/2010 | Brochu et al. | |
| 7,874,808 | B2 * | 1/2011 | Stiles | 417/18 |
| 2003/0061653 | A1 * | 4/2003 | Carlet | 4/541.1 |
| 2005/0288821 | A1 | 12/2005 | Laflamme et al. | |
| 2008/0095639 | A1 | 4/2008 | Bartos et al. | |

FOREIGN PATENT DOCUMENTS

| | | |
|---|---|---|
| JP | 2000240593 | 9/2000 |
| JP | 2005313008 | 11/2005 |
| WO | PCT/CA2008/000052 | 4/2008 |
| WO | WO2008/083494 | 7/2008 |

OTHER PUBLICATIONS

Office Action mailed on Oct. 25, 2011 in connection with U.S. Appl. No. 12/914,369, 12 pages.

* cited by examiner

SPA SYSTEM WITH FLOW CONTROL FEATURE

FIELD OF THE INVENTION

The present invention relates to recreational or therapeutic water circulation system such as spas, hot tubs, whirlpools, and jetted baths. Particularly, it relates to an improved water circulation system where the flow of water that is discharged into a tub or basin is selectively variable and controllable by a user.

BACKGROUND

For some time, consumers have enjoyed recreational and hydro-therapeutic benefits of spas, hot tubs, whirlpools, and jetted baths (all forms of the aforementioned and derivatives thereof are referred to hereinafter as "spa system"). Spa systems can serve as a retreat for relaxation or socialization. They can also provide therapeutic benefits by making use of circulating heated water to treat muscles and/or joints to improve physical well being. Generally, the circulating heated water is passed through a jet or nozzle to accelerate the flow of the water as it is discharged into a tub. This jetted flow or jetted water offers therapeutic massages to the user.

At the present time, spa systems include one or more AC induction motors that operate at one, two or three fixed preset speeds to deliver jetted water. A problem with this arrangement is that these preset speeds are defined by the manufacturer and cannot be changed by the user. Consequently, the user is unable to adjust the flow of the jetted water to his preference, and the blast of jetted water produced by the pump may be too strong, too weak, or uncomfortable for the user.

Current spa systems also typically include a circulating pump, separate from the jetting pump, for circulating water during "standby." Generally, "standby" is the time period when the jetting pump is not operating or when the spa system is not occupied by a user. Typically, the circulating pump is a single-speed pump that is programmed to turn ON to filter, sanitize, and heat the water. In other prior art systems, a single two-speed pump may be used for both jetting and circulating. But even here, a single high speed is used for jetting, and a single low speed is used for filtering, sanitizing and heating the water during standby. A problem with these configurations is that the same speed is used to filter, sanitize and heat the spa system's water. In practice, however, the water flow that is needed to heat the water differs from the flow that is required to filter and/or sanitize the water. Typically, for example, the pump speed required for filtering and sanitizing is lower than the pump speed that is needed to heat the water. Therefore, the current spa systems waste energy because unnecessary power is expended during the filtering and/or sanitizing cycle.

Accordingly, it is an object of the invention to provide improved methods and apparatus for controlling the speed of a pump to adjust the water flow through an inlet to a tub or basin to a user's preference. It is also an object of the invention to provide an improved spa system that can deliver new and different jetting modes to be enjoyed by the user. It is further an object of the invention to provide improved methods and apparatus for operating a pump to deliver optimum or near optimum speed for filtering, sanitizing and heating water. It is further an object of the invention to provide the above-identified objects in an energy efficient manner over current systems.

SUMMARY OF THE INVENTION

According to one embodiment of the present invention, there is provided a spa system that includes a tub, a pump assembly and a controller. The tub is capable of retaining water, and has at least one outlet port and at least one inlet port. The pump assembly includes a pump driven by a BLDC pump and circulates water from the outlet port to the inlet port of the tub. The controller is coupled to the BLDC motor and controls the speed of the BLDC motor in response to a user's input. The speed of the BLDC motor can be set to any speed within the speed range of the BLDC motor to adjust the flow rate of the water that is discharged from the pump into the tub through the inlet port.

The spa system may include a user interface control pad for the user to indicate the desired BLDC speed or the strength of water flow through the inlet port of the tub. The spa system may also produce at least one jetting mode in response to a user input. The jetting mode may be a pulse mode, a sinusoidal mode, a ramp mode, or a saw-tooth mode. One or more characteristic of a jetting mode may also be modified in response to input from a user. The BLDC motor of the pump assembly may be a 6 HP motor with a speed range of zero rpm to 4000 rpm.

According to another embodiment of the invention, the spa system includes a tub, a first pump assembly, a filter, and a heater. The tub is capable of retaining water and has an outlet port and an inlet port. The first pump assembly includes a BLDC motor and a pump and circulates water from the tub's outlet port to the inlet port. The filter and heater are in fluid communication with the first pump assembly. The BLDC motor of the first pump assembly operates at a first speed when the heater is activated to heat the circulating water, and at a second speed when the heater is not activated.

Optionally, this second embodiment may include a controller coupled to the BLDC motor of the first pump assembly to control the speed of the motor. The first and second speeds can be set to any speed within the speed range of said first BLDC motor to adjust the flow rate of the circulating water. The speeds of the BLDC motor of the first pump assembly may also be optimized to filter the circulating water, or to heat the circulating water. The first pump assembly may also be operated at a third speed, set to any speed within the speed range of the first BLDC motor, for jetting.

The second embodiment may further include a second pump assembly that circulates water. The second pump assembly may also include a BLDC motor that can be set to any speed within the speed range of this BLDC motor to adjust the flow rate of the water discharged from the second pump assembly into the tub.

According to another embodiment, a spa system includes a tub, a jetting pump assembly and a circulating pump assembly. The tub is capable of retaining water, and has first and second outlet ports, and first and second inlet ports. The jetting pump assembly includes a BLDC motor and a pump to circulate water from the first outlet port to the first inlet port. The BLDC motor of the jetting pump assembly can be set to any speed within the speed range of the BLDC motor to adjust the flow rate of the water discharged from the first pump into the tub through the first inlet port according to a user's preference. The circulating pump assembly includes a pump to circulate water from the second outlet port to the second inlet port. The circulating pump assembly operates at a first speed when a heater is activated to heat the circulating water, and at a second speed when the heater is not activated. Optionally, the circulating pump assembly may include a BLDC motor.

Also, the first and second outlet ports may be the same port. Further, the first and second inlet ports may be the same port.

In another embodiment, the spa system includes a tub and a circulating pump assembly. The circulating pump assembly operates to circulate water from an outlet port to an inlet port of a tub during standby. Where the circulating pump assembly operates at a first speed when a heater is activated to heat the circulating water, and at a second speed when the heater is not activated.

BRIEF DESCRIPTION OF THE DRAWINGS

Other objects and features will become apparent from the following detailed description taken in connection with the accompanying drawings. However, the drawings are provided for purpose of illustration only, and are not intended as a definition of the limits of the invention.

In the drawings, wherein the same reference number indicates the same element throughout the several views.

DETAILED DESCRIPTION

Figure 1:
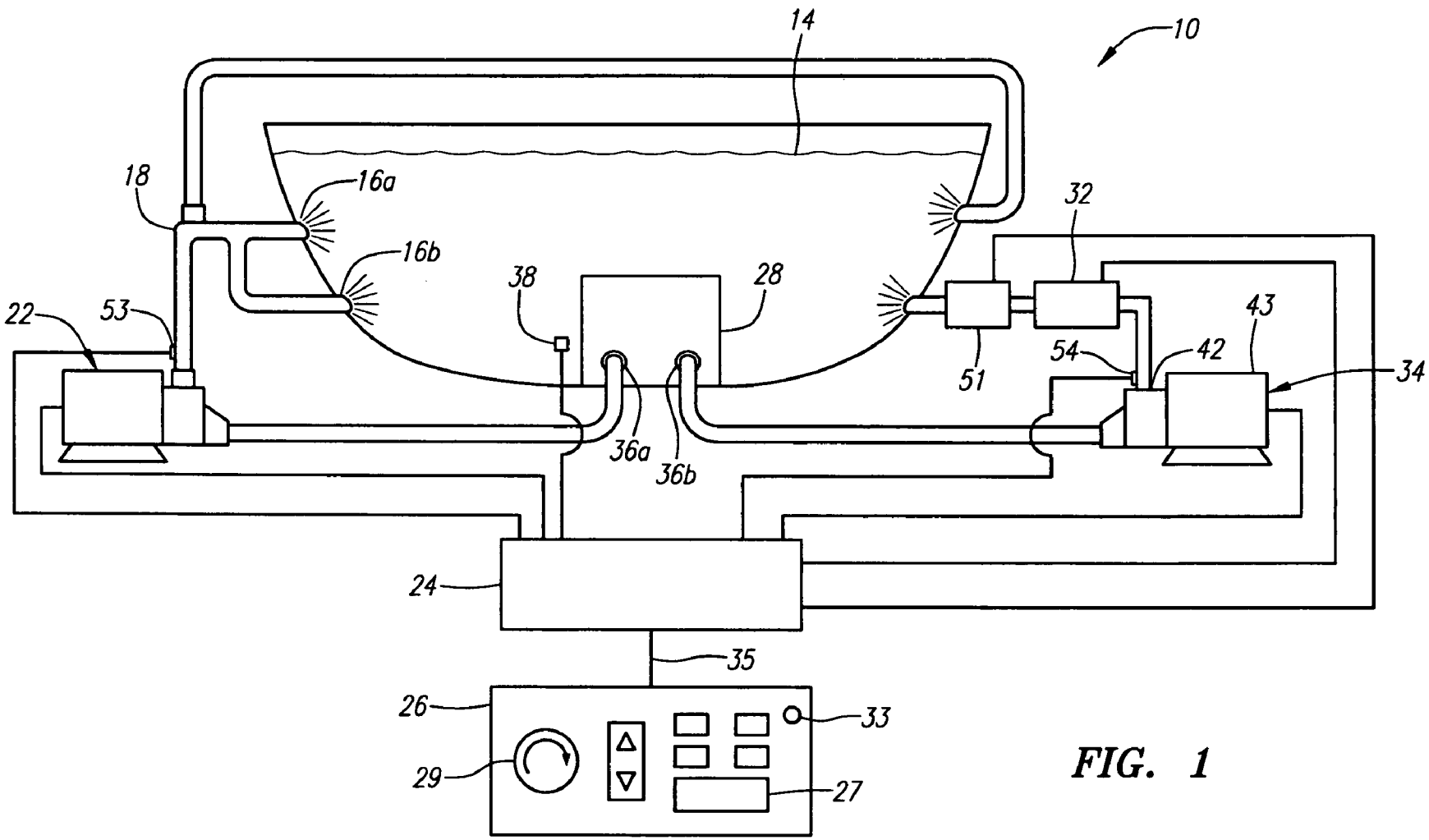
FIG. 1 is a block diagram of an embodiment of a spa system.
Figure 3:
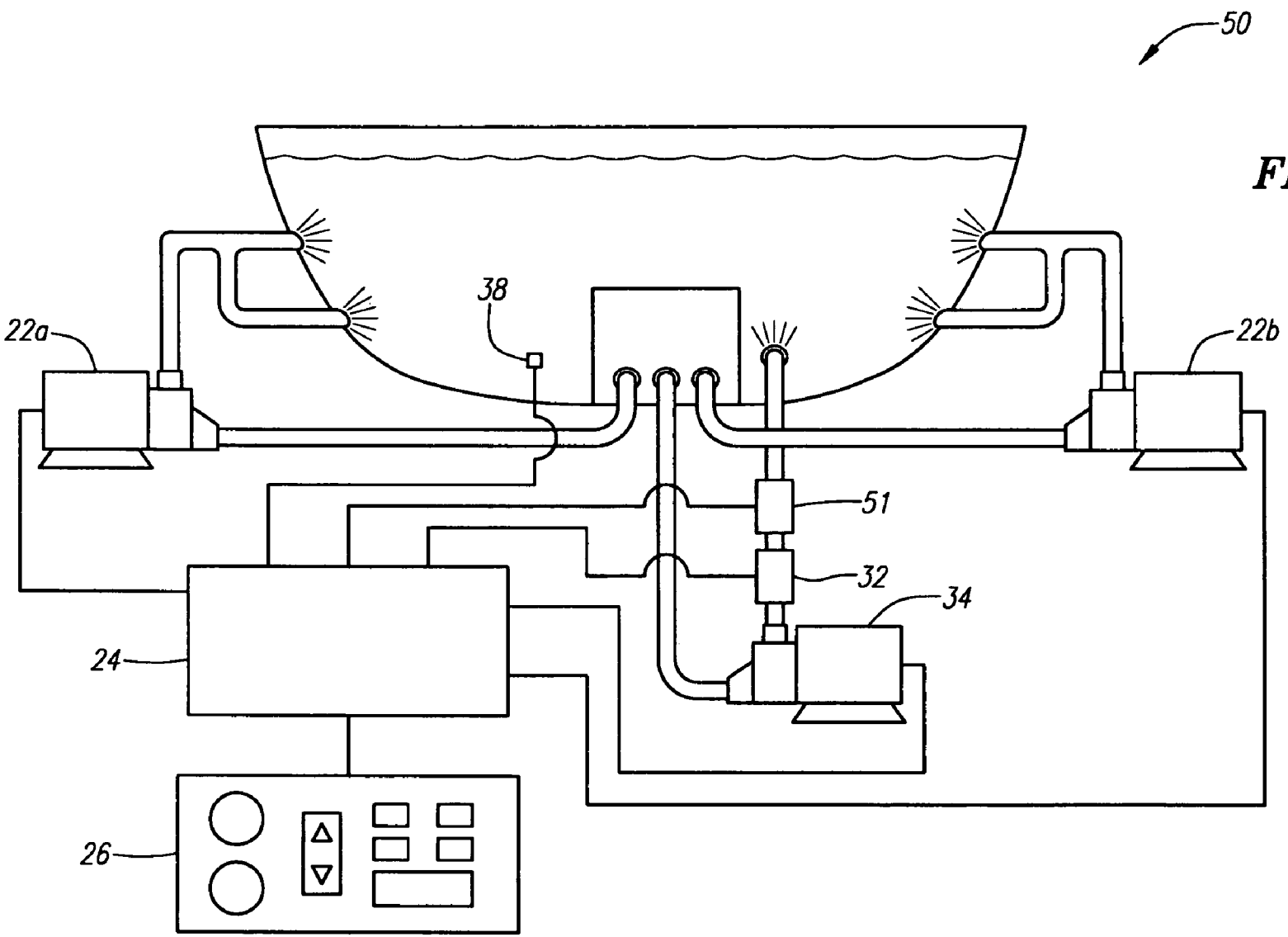
FIG. 3 is a block diagram of a second embodiment of a spa system.
Figure 4:
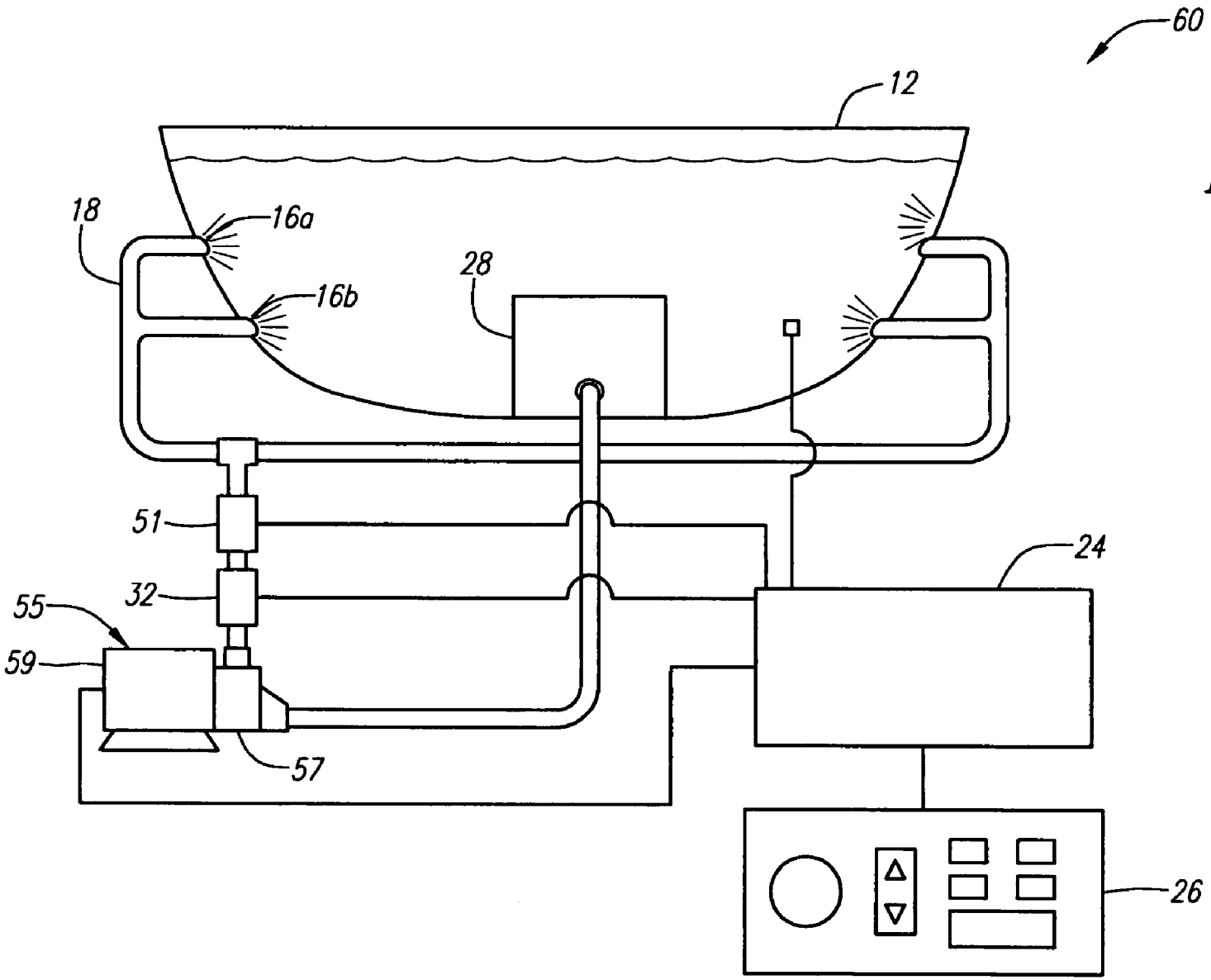
FIG. 4 is a block diagram of a third embodiment of a spa system.

Embodiments of the present invention will now be described with reference to the drawings. Referring to FIGS. 1, 3 and 4, spa systems 10, 50 and 60 are each an illustrative embodiment of present invention and incorporates various inventive features or combinations. These features are described in detail below and illustrated in the accompanying figures for the purpose of describing the preferred embodiments of the invention. It is to be expressly understood, however, that the present invention is not restricted to the spa systems described herein. Rather, the present invention includes a water recirculation system that incorporates one or more of the disclosed features or combinations. For example, a system may or may not include a filter, a sanitizer, a heater, or a jet. It is to be understood that the present invention is directed to each of the inventive features or combination of features of the systems described below.

As used herein, the term "spa system" refers to a system which includes a tub or basin that is suitable to contain a fluid such as water and which includes one or more stations that may each be occupied by a person. In at least one station, one or more jets may be selectively located. As used herein, a "jet" refers to an orifice or nozzle through which a fluid may be pumped, discharged or dispensed into the tub. Jets may be provided in various shapes and sizes as commonly known in the art.

Turning now in detail to the drawings, as shown in FIG. 1, a first embodiment of a spa system 10 includes a tub 12, jets 16*a* and 16*b*, a pipe system 18, a jetting pump assembly 22, a controller 24, a control pad 26, a filter 28, a heater 32, a sanitizer 51, and a circulating pump assembly 34. The spa system 10 may also include temperature sensor 38, and flow sensors 53, 54, which may be located about the discharge end of the jetting pump assembly 22 and circulating pump assembly 34, respectively. The tub 12 holds fluid, such as water 14, and may be sized to be occupied by one or more users. The tub 12 is also preferably shaped to facilitate the user to be in a seated position. The pipe system 18 connects the various components of the spa system 10.

In the illustrative embodiment, the controller 24 controls the operation of the spa system 10 and is electrically coupled to the jetting pump assembly 22, the heater 32, the sanitizer 51, the circulating pump assembly 34, temperature sensor 38, and flow sensors 53, 54. Power to the controller 24 may be by commonly known means suitable for commercial or residential service. The controller 24 may regulate and control the voltage and current that are delivered to the various spa system 10 components. The controller 24 may include a microprocessor or discrete devices and amplifiers to establish and deliver the desired voltage/current to the system components. The controller 24 may also monitor spa system parameters such as, for example, water temperature, water flow rate, or motor parameters.

The controller 24 is also electrically connected to one or more control pad 26. The control pad 26 is located at a convenient location for easy access by the user and facilitates the user to enter input for operating the spa system 10.

Figure 2:
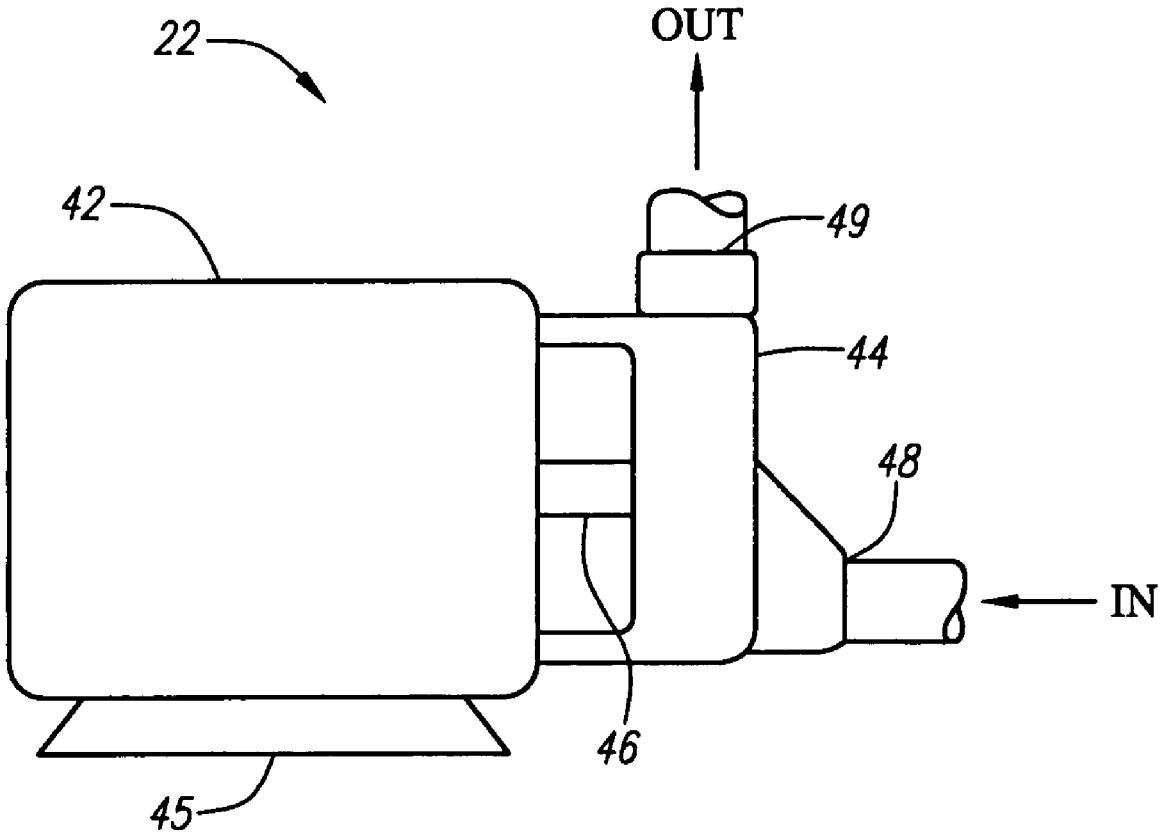
FIG. 2 is side view of an embodiment of a jetting pump assembly.

In the illustrative embodiment of FIG. 1, the jetting pump assembly 22 controls the flow of jetted water that is returned to the tub 12. Water is drawn from the tub 12 to the jetting pump assembly 22 through filter 28 and outlet port 36*a*, and discharged back to the tub 12 through jets 16*a*, 16*b*. The filter 28 may be a single filter element or a plurality of filter elements, and preferably contained in a filter compartment. Referring to FIG. 2, the jetting pump assembly 22 includes a brushless DC ("BLDC") motor 42, and a pump 44. The BLDC motor 42 includes a base 45 and a shaft 46. The shaft 46 is coupled to the pump 44, which includes an inlet 48 and outlet 49, and drives the impeller of the pump 44 to advance the water to the tub 12. Generally, an increase in the speed of the BLDC motor 42 corresponds to an increase in the flow of water through the outlet 49 of the pump 44.

The preferred jetting pump assembly 22 includes a BLDC motor 42 because compared to an AC induction motor, as used in prior art spa systems, a BLDC motor has greater reliability, better efficiency, and longer life. Also, unlike an AC induction motor, a BLDC motor advantageously has the ability to operate at any speed between zero revolutions per minute ("rpm") and its maximum speed. Accordingly, through control pad 26 and controller 24, the user is able to adjust the speed of the BLDC motor 42 to any speed within its range, and thereby control the water flow through jets 16*a*, 16*b*. Unlike prior art spa systems that provide one, two or three fixed speeds for jetting, the jetting pump assembly 22 as described herein facilitates the user to adjust the speed of the BLDC motor 42 to any value to achieve the desired flow rate. In this way, the user may set the strength of the jetted water to his exact preference and receive maximum therapeutic benefit from the spa system.

In addition to providing the ability to vary the strength of the jetted water to the user, the jetting pump assembly 22 including the BLDC motor 42 provides the user or the manufacturer to set the upper and lower limit of available speed to a desired range. For example, the lower limit may be set at 600 rpm so as to indicate to the user that the jetting pump assembly 22 power is ON. This may be desirable because extremely low speeds may not produce a flow that the user can detect. By setting the lower limit to a speed which will produce a flow that is detectable by the user, he can avoid inadvertently leaving the jetting pump assembly 220N and wasting energy. Also for example, the upper limit of the jetting pump assembly 22 may be set to 3000 rpm to prevent an uncomfortably high jetted flow to the user. This may be desirable, for example, where the spa system is used primarily by older bathers. By setting the upper limit to a lower speed, inadvertent injury to the user can be avoided.

Also, the BLDC motor 42 may be programmed to any speed range and operate at any particular speed without a significant loss in efficiency. For example, the BLDC motor 42 can be programmed to have lower and upper limit speeds of 600 rpm to 2500 rpm; 600 rpm to 3500 rpm; 600 rpm to 4000 rpm; or 1200 rpm to 3500 rpm. However, regardless of the range limit selected, the BLDC motor 42 of the jetting pump assembly 22 allows the user to adjust the BLDC motor 42 to any speed within the range and to produce water flow through the jets 16*a*, 16*b* that he desires.

In the illustrative embodiment shown in FIG. 1, the user may be prompted by a display screen 27 on the control pad 26 to input the lower and upper speed limits of the jetting pump assembly 22. Once the limits are defined, a dial 29 on the control pad 26 may be maneuvered by the user to adjust the speed of the BLDC motor 42 and, consequently, adjust the strength of the water flow through jets 16*a*, 16*b* to his preference. Although the embodiment described employs a dial 29 to adjust the speed of the BLDC motor 42, the present invention is not limited by such an arrangement. The speed of the BLDC motor 42 may be adjusted by other suitable means, such as for example, a touch pad switch labeled with up/down arrows and a digital LED indication of the speed of the BLDC motor 42 or strength of the jetted water.

In a particular implementation of the jetting pump assembly 22, the user may preset the strength of the jetted water to his preference and store the preset value in controller 24. In this way, the user may simply recall the preset value instead of having to adjust the speed of the BLDC motor 42 or the strength of the jetted water each time he uses the spa system 10. In a preferred embodiment, the user may define a plurality of preset values, each to his preference, and store the plurality of preset values in the controller 24 for later recall.

Figure 5A:
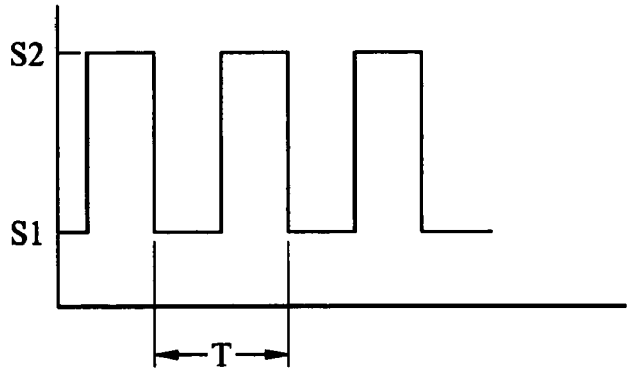
FIG. 5A-5D are illustrative examples of various jetting modes that may be produced by a jetting pump assembly according to the present invention.

The jetting pump assembly 22 including the BLDC motor 42 can also be controlled to operate in particular jetting modes. For example, through the controller 24, operating routines can be employed to generate jetting modes as represented in FIGS. 5A through 5G. FIG. 5A illustrates a pulse mode, where the jetting speed produced by the BLDC motor 42 cycles between a first speed (S1) and a second speed (S2) a number of times over a period of time (T). In the preferred embodiment, the user can select the pulse mode by inputting a command using the control pad 26. Preferably, the user may also select or adjust the pulse mode parameters, i.e., the first speed (S1), second speed (S2) and period (T), to any value to control the pulsing action as desired. Alternatively, the pulse mode parameters may be preset and stored in controller 24.

Figure 5B:
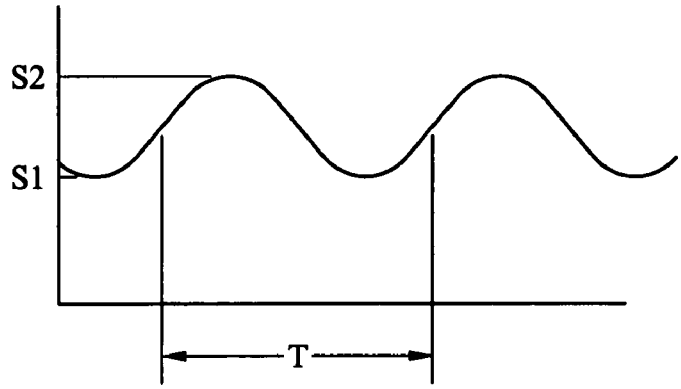

FIG. 5B illustrates a sinusoidal mode, where the jetting speed cycles between a first speed (S1) and a second speed (S2) over a period of time (T) in sinusoidal form. Similar to the pulse mode as described above, these parameters may be adjusted by the user to his preference. Alternatively, the sinusoidal mode parameters may also be preset and stored in controller 24.

Figure 5C:
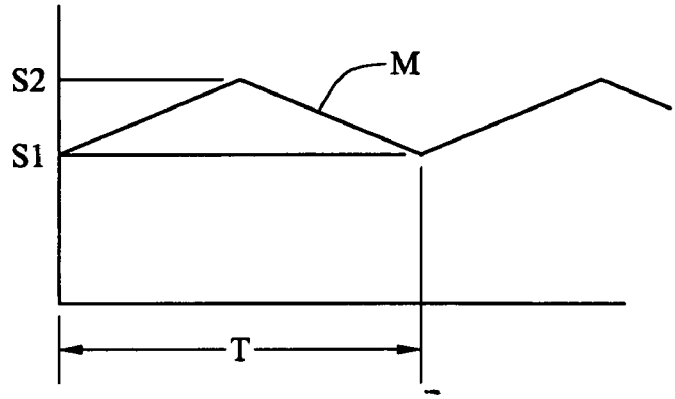

FIG. 5C illustrates a ramp mode, where the jetting speed increases and decreases in a linear slope (M) between a first speed (S1) and a second speed (S2) over a period of time (T). The slope (M) may be adjusted to make the jetting force intensity increase gradually or sharply. In a preferred embodiment, the speeds, the period and the slope is selected by the user to his preference. Alternatively, the ramp mode parameters may be preset and stored in controller 24.

Figure 5D:
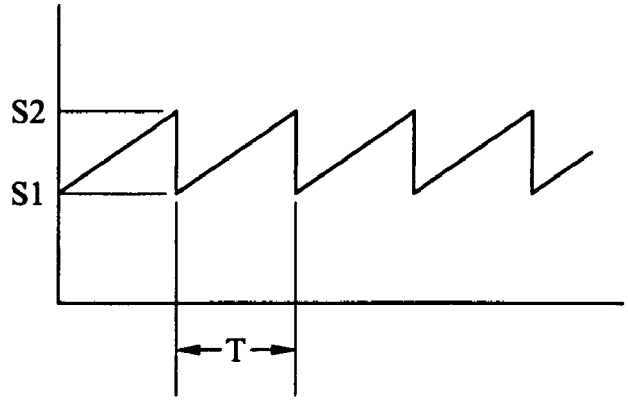

FIG. 5D illustrates a saw-tooth mode, where the jetting speed increases from a first speed (S1) to a second speed (S2) over time (T), then substantially instantaneously drops to the first speed (S1), and repeats this cycle. Again, these parameters may be adjusted by the user or they may be preset and stored in controller 24.

The present invention is not limited to these specific jetting modes. The jetting pump assembly 24 including the BLDC motor 42 may operate under other jetting routines which may vary jetting over different speeds, frequencies, and/or speed versus time patterns. Advantageously, unlike AC motors, these jetting modes and other jetting routines can be employed by the BLDC motor 42 without a significant loss in efficiency.

In yet another alternate embodiment, the controller 24 may be programmed to have default settings for the user to choose from. For example, the user may be given the option of adjusting the jetted water speed to his own preference, selecting a preset speed, selecting a preset jetting mode, or overriding jetting mode parameters as desired and storing the preferred jetting mode for later recall. In the preferred embodiment, the BLDC motor 42, also called an electronically commutated motor, is a 6 HP continuous duty motor with a speed range of zero rpm to 4000 rpm. However, other HP and speed range combination may be implemented.

In another alternate embodiment, the controller 24 can be used to monitor spa system performance. For example, the flow through the filter 28 will reduce over time as it traps debris and particles. The controller can detect this change in the resistance across the filter 28 by monitoring the speed and/or the current draw of the BLDC motor 42. Alternatively, the controller 24 can detect this change by considering the water flow rate measured by a flow sensor 53. Regardless of the means to detect the condition of the filter 28, the controller 24 can compensate for the clogging filter 28 by adjusting the speed of the BLDC motor 42 to maintain the desired jetting speed and flow as desired by the user.

In yet another embodiment, the jetting pump assembly 22 may deliver water to features such as waterfalls and/or fountains. Utilizing the capability of the BLDC motor to control the speed of the jetting pump, the water flow rate to these features can be optimized for effect and, if desired, modulated to vary in concert with an audio system of the spa.

Turning to another aspect of the present invention, the spa system 10 also includes a circulating pump assembly 34 which draws water from the tub 12 through filter 28 and outlet port 36*b*. The discharge from the circulating pump assembly 34 passes through a heater 32 and a sanitizer 51 before returning to the tub 12. The circulating pump assembly 34 generally operates during the standby mode and controls the flow of water during the filtering, sanitizing and heating periods of the spa system 10. In a preferred embodiment, the circulating pump assembly 34 is also powered and controlled by the controller 24. Generally, the circulating pump assembly 34 operates at a lower speed range than the jetting pump assembly 22. In the illustrative embodiment, the circulating pump assembly 34 includes a pump 42 that is driven by a motor 43. In a preferred embodiment, the motor 43 is a BLDC motor programmed to operate at two-speeds.

In a preferred embodiment, the heating cycle is triggered whenever the temperature sensor 38 detects that the spa system's water temperature falls below a specified range, and this information is processed by the controller 24. As shown in FIG. 1, the temperature sensor 38 is located along the interior wall of the tub 12. However, multiple temperature sensors may be used, and they may be disposed at various locations throughout the spa system 10.

Once the controller 24 determines to trigger the heating cycle, signals are sent to activate the circulating pump assembly 34 and the heater 32. As the circulating pump assembly 34 advances water through the heater 32, the water temperature in the spa system 10 is eventually returned to the desired range. Generally, the heater manufacturer defines the desired flow rate through the heater which will yield the most effective heat transfer to the passing water. The speed of the circulating pump needed to achieve this desired flow rate is affected by, among other things, the diameter and length of the pipes used in the piping system 18, and the resistance of the filter 28 and the heater 32. Therefore, the speed of the BLDC motor during the heating cycle varies according to the total resistance of the particular spa system. However, because the BLDC motor can operate at any speed, the circulating pump assembly 34 can produce the desired flow which will most effectively heat the circulating water. In this way, energy conservation is realized using the BLDC motor. Once the temperature is raised to the specified range, the controller 24 turns the heater 32 and the circulating pump assembly 34 to OFF. Alternatively, the controller 24 may only turn the heater 32 OFF and continue operating the circulating pump assembly 34 for additional filtering. Typically, the circulating pump assembly 34 operates at a speed between 1200 rpm and 1900 rpm during the heating cycle.

The circulating pump assembly 34 also operates to filter and/or sanitize the water. However, the circulating pump assembly 34 need not operate at the speed needed to heat the water during the filtering and/or sanitizing operation. This is because the primary consideration for filtering and/or sanitizing the spa system water is to merely advance the water through filter 28, and the pump speed required is lower than the speed needed to heat the water. For example, filtering may be performed at a rate needed to exchange or pass the water in the spa system through the filter every forty-eight hours. Preferably, water filtering and sanitizing is accomplished during off-peak hours of the day to save energy. In a preferred embodiment, the controller 24 is programmed to run the circulating pump assembly 34 from 1 am to 6 am. Alternatively, the controller 24 may be programmed to run the circulating pump assembly 34 at a very low speed to filter and/or sanitize the water in the spa system 10 continuously. Typically, the circulating pump assembly 34 operates at a speed between 700 rpm to 1100 rpm.

Because the motor speed or the flow needed to heat and filter/sanitize the water in the spa system 10 differ, the circulating pump assembly 34 of the present invention operates in at least two different speeds: a first speed for heating and a second speed for filtering and/or sanitizing, i.e., conditioning, the water. In this first embodiment, the circulating pump assembly 34 includes a pump 42 that is driven by a motor 43 that is a BLDC motor. Advantageously, because the BLDC motor can operate at any speed, the pump 42 may be driven at any first and second speeds. For example, for a particular spa system 10, the desired water flow rate for the heating cycle may be achieved by operating the motor 43 at 1400 rpm, and the desired flow rate for the filtering/sanitizing cycle may be achieved by operating the circulating pump assembly 34 at 850 rpm. The circulating pump assembly 34 with a BLDC motor may be programmed by the controller 24 to operate precisely at a first speed of 1400 rpm, and a second speed of 850 rpm. As discussed above, the controller may turn ON the circulating pump assembly 34 to a first speed in response to detecting that the water temperature has fallen outside a specified range. The circulating pump assembly 34 may further be programmed to turn ON at a second speed at a predetermined time schedule to filter and/or sanitize. In this way, the circulating pump assembly 34 is used at optimum speeds to achieve heating and filtering and/or sanitizing. Because no more than necessary energy is used to heat, sanitize, and/or filter the water, the spa system 10 is more efficient than the prior art systems that use a single-speed circulating pump to perform these operations.

Also, as discussed above, flow through the spa system 10 will be affected over time as the filter 28 becomes clogged with debris and particles. As shown in FIG. 1, the controller 26 is connected to the circulating pump assembly 34 and a flow sensor 54. Because the controller 24 monitors the BLDC motor and flow parameters, it can detect a change in the resistance across the filter 28. Accordingly, the speed of the circulating pump assembly 34 can be adjusted to compensate for a clogged filter 28 and continue to deliver optimum flow rate to the heater 32. Similarly, during the filtering or sanitizing period, the condition of the filter 28 may be compensated and the speed of the BLDC adjusted to achieve the desired filtering or sanitizing flow rate. Moreover, by monitoring the change in the speed of the BLDC motor needed to maintain the desired flow through the spa system, the controller 24 can determine the condition of the filter 28 and alert the user of the need to replace the filter by, for example, activating an alert light 33 on the control pad 26.

In an alternate circulating pump assembly embodiment, the motor 43 of the circulating pump assembly 34 may be a two-speed AC induction motor. Because a two-speed AC induction motor is restricted in the available speeds it may generate, optimum speeds to heat and filter and/or sanitize the water may not be achieved. However, the two-speed AC induction motor may be designed to achieve greater energy efficiency over the prior art single-speed motor application. For example, the minimum conditioning speed for a particular spa system may be 900 rpm, and the minimum heating speed may be 1750 rpm. A two-speed AC motor may be designed to produce a first speed of 1050 rpm and a second speed of 1750 rpm. Although the two speeds may not match each of the desired speeds, a substantial energy saving is still achieved over a single-speed pump by running the filtering and/or sanitizing cycle at the reduced speed of 1050 rpm.

Thus, a novel and improved spa system 10 has been shown and described. The variable and controllable jetting flow produced by the jetting pump assembly 22 as described herein has not heretofore been combined for use in a spa system. The current spa systems include AC motors to drive the jetting pump which cannot provide variable speed control over a range of speeds to the user. The jetting pump assembly 22, including a BLDC motor 42, is more energy efficient than AC motors used in prior art spa systems. This is because AC motors are optimal at only one speed, and their efficiency drops significantly at other speeds. In contrast, the BLDC has a relatively flat efficiency curve over the operating speed range. Therefore, regardless of the jetting flow the user chooses, the efficiency of the BLDC motor is generally maintained. In this way, the BLDC motor facilitates energy efficient operation of the jetting pump assembly 22 over many operating speeds.

Other variable speed motors, such as a three-speed AC induction motor, a single speed AC induction motor or a permanent magnet rotor motor powered by a variable frequency electronic drive may be contemplated. However, these motors are less efficient than a BLDC motor, more expensive than a BLDC motor, or both. A universal type brush motor may also provide variable speed. However, universal type motors tend to be noisy and have a relatively short life as compared to a BLDC motor.

Moreover, the jetting pump assembly 22 as disclosed herein can advantageously operate in the pulse mode, sinusoidal mode, ramp mode, and saw-tooth mode, among other jetting routines, with no detrimental effect on the jetting pump assembly. An AC induction motor, on the other hand, would generate significant heat when used in these modes and result in a shortened life or a failure to operate.

The efficiency of the BLDC motor, over its AC based counterparts, used in either the jetting pump assembly or the circulating pump assembly 34 also facilitates the spa system 10 to operate the heater 32 concurrently with the pump assemblies. In prior known spa systems, the jetting pump and the heater typically could not be operated at the same time without overloading the system's electrical capacity, or the commercial or residential electrical service capacity. As a result, the water in the spa system may cool down while the jetting pumps are operating. In contrast, the pump assemblies including a BLDC motor as disclosed herein have lower energy consumption and facilitates a spa system to be designed whereby the heater and the jetting pump can be operated at the same time. In this way, the user can enjoy the benefit of heated hydrotherapeutic massages.

In a second embodiment, as shown in FIG. 3, a spa system 50 includes all the features and components of the spa system 10 illustrated in FIG. 1. However, spa system 50 includes a plurality of jetting pump assemblies 22*a*, 22*b* to provide individual flow control to a plurality of user stations. In this way, jetting preference of individual users may be satisfied.

In a third embodiment, as shown in FIG. 4, a spa system 60 includes a tub 12, jets 16*a*, 16*b*, a pipe system 18, a controller 24, a control pad 26, a filter 28, a heater 32, a sanitizer 51, and a pump assembly 55. The pump assembly 55, includes a pump 57 and a BLDC motor 59. Notably, the spa system 60 does not include a separate jetting pump assembly and a circulating pump assembly. Instead, the pump assembly 55 and the controller 24 is configured to employ the pump assembly 55 to perform the functions of jetting and circulating. That is, when a user desires to receive jetted water, a command is input to the control pad 26 and controllable high pressure jetted water is received by the user. As described in detail above, the speed of the BLDC motor, and consequently, the flow of the jetted water can be varied and adjusted by the user to his preference.

During the standby mode, the spa system 60 makes use of the pump assembly 55 for the circulating function. That is, if the temperature of the spa water is detected by the controller 24 to fall below a specified range, signals are sent to the pump assembly 55 and the heater 32 to turn ON. Particularly, the pump assembly 55 is activated to operate at a first speed, which is the desired speed to achieve the desired flow rate through the heater 32. Once the temperature rises to the specified range, the controller 24 signals the pump assembly 55 and the heater 32 to turn OFF.

Also in spa system 60, to perform the filtering and/or sanitizing function, the controller 24 may be programmed to turn on the pump assembly 55 to a second speed for a period of time. This second speed is selected according to the filtering and/or sanitizing requirement. As described above, the second speed to filter and/or sanitize is less than the first speed to heat the water. In this way, energy efficiency is achieved.

The pump assembly 55 of the spa system 60 advantageously utilizes a single assembly to perform the function of jetting and circulating. Having such an arrangement facilitates minimizing the number of components needed for a spa system and provides a way for users to enjoy hydro-therapeutic benefits in situations where space is limited.

Referring to FIG. 2, in another application of the pump assembly 22, the variable speed capability of the pump assembly 22 may be used to create a continuous current in a tub or basin to facilitate a user to swim in place. Swimming provides good aerobic exercise without the high impact and joint stress of running or jogging. But the cost and space required may limit the user's ability to acquire a pool at his residence. A continuous current tub facilitates the user to realize the health benefits of swimming without the need for a full size pool. The pump assembly 22 with a BLDC motor 42 may be configured to operate at any speed. In this way, the pump assembly 22 facilitates the user to adjust the current of the water flow according to his swimming ability or preference. Similarly, the pump assembly 22 including a BLDC motor 42 may be used in a swim spa system, which is a system that includes a continuous current feature for swimming and a jetting feature for hydrotherapy.

Various embodiments of spa systems and their respective components have been presented in the foregoing disclosure. As already discussed, the improved spa system as described herein is not limited by the illustrative embodiments shown in the figures. While preferred embodiments of the herein invention have been described, numerous modifications, alterations, alternate embodiments, and alternate materials may be contemplated by those skilled in the art and may be utilized in accomplishing the various aspects of the present invention. For example, the spa system according to this invention may include three, four or more jetting pump assemblies, each arranged for each station in the tub 12. Also, while each spa system disclosed herein employ a heater, filter, and a sanitizer, the particulars of the present invention may be practiced with any or none of these components. It is envisioned that all such alternate embodiments are considered to be within the scope of the present invention as described by the appended claims.

What is claimed is:

1. A control system for a bathing unit, the bathing unit including a receptacle for holding water, the receptacle having at least one outlet port and at least one inlet port, said control system comprising:

a) a circulation system through which water can flow between the outlet port and the inlet port of the receptacle;

b) a jetting pump assembly suitable for pumping water through said circulation system, said jetting pump assembly having a motor driving a pump, the motor being configured for operating at a plurality of different motor speeds within a range of possible motor speeds;

c) a controller in communication with said jetting pump assembly, said controller having:

i) a memory unit; and ii) a user interface configured for:

1. enabling a human operator of the bathing unit to specify a set of parameters to create a user configured jetting mode and to store the user configured jetting mode in the memory unit for later recall, wherein the user interface enables the human operator to independently specify a particular first motor speed and a particular second motor speed when creating the user configured jetting mode; and 2. allowing selection of a jetting mode amongst jetting modes stored in the memory unit, the jetting modes stored in the memory unit including the user configured jetting mode and at least one other jetting mode;

said controller being responsive to the selection of the user configured jetting mode from the memory unit via the user interface for causing the motor driving the pump of the jetting assembly to vary its speed based in part on the specified particular first motor speed and the specified particular second motor speed.

2. A control system as defined in claim 1, wherein the user configured jetting mode conveys a periodic motor speed pattern.

3. A control system as defined in claim 1, wherein the user configured jetting mode conveys a jetting mode selected from the set consisting of a pulse mode, a sinusoidal mode, a ramp mode and a saw-tooth mode.

4. A control system as defined in claim 1, wherein the specified particular first motor speed conveys a lower speed limit and the specified particular second motor speed conveys an upper speed limit.

5. A control system as defined in claim 4, wherein the user interface allows the human operator to create the user configured jetting mode at least in part by specifying a periodic motor speed pattern associated with the motor driving the pump.

6. A control system as defined in claim 5, wherein the specified periodic motor speed pattern is one of a pulse mode, a sinusoidal mode, a ramp mode and a saw-tooth mode.

7. A control system as defined in claim 1, wherein the memory further stores a plurality of preset jetting modes in addition to the user configured jetting mode.

8. A control system for a bathing unit, the bathing unit including a receptacle for holding water, the receptacle having at least one outlet port and at least one inlet port, said control system comprising:

a) a circulation system through which water can flow between the outlet port and the inlet port of the receptacle;

b) a jetting pump assembly suitable for pumping water through said circulation system, said jetting pump assembly having a motor driving a pump, the motor being configured for operating at a plurality of different motor speeds within a range of possible motor speeds;

c) a controller in communication with said jetting pump assembly, said controller having:

i) a memory unit;

ii) a user interface configured for:

1) enabling a human operator to specify a set of parameters to create a user configured setting and to store the user configured setting in the memory unit for later recall, wherein the user interface enables the human operator to independently specify a particular first motor speed and a particular second motor speed when creating the user configured setting;

2) allowing selection of a setting amongst settings stored in the memory unit, the settings stored in the memory unit including the user configured setting and at least one other setting;

said controller being responsive to the selection of the user configured setting from the memory unit via the user interface for causing the motor driving the pump of the jetting assembly to vary its speed based in part on the specified particular first motor speed and the specified particular second motor speed.

9. A control system as defined in claim 8, wherein the specified particular first motor speed conveys a lower speed limit and the specified particular second motor speed conveys an upper speed limit.

10. A control system as defined in claim 8, wherein the memory further stores a plurality of preset settings in addition to the user configured setting.

11. A control system for a bathing unit, the bathing unit including a receptacle for holding water, the receptacle having at least one outlet port and at least one inlet port, said control system comprising:

a) a circulation system through which water can flow between the outlet port and the inlet port of the receptacle;

b) a jetting pump assembly suitable for pumping water through said circulation system, said jetting pump assembly having a motor driving a pump, the motor being configured for operating at a plurality of different motor speeds within a range of possible motor speeds;

c) a controller in communication with said jetting pump assembly, said controller having:

i. a memory unit;

ii. a user interface configured for enabling a human operator of the bathing unit to create a user configured jetting mode at least in part by selecting independently:

(1) a particular first speed from the range of possible motor speeds; and (2) a particular second speed from the range of possible motor speeds;

iii. a processor in communication with said user interface for causing the motor driving the pump of the jetting assembly to vary its speed based in part on the selected particular first speed and the selected particular second speed.

12. A control system as defined in claim 11, wherein the particular first speed conveys a lower speed limit and the particular second speed conveys an upper speed limit.

13. A control system as defined in claim 12, wherein the user interface allows the human operator to create the user configured jetting mode at least in part by specifying a periodic motor speed pattern associated with the motor driving the pump.

14. A control system as defined in claim 13, wherein the specified periodic motor speed pattern is one of a pulse mode, a sinusoidal mode, a ramp mode and a saw-tooth mode.

15. A control system as defined in claim 13, wherein the user interface allows the human operator to select a time period associated with the specified periodic motor speed pattern, the selected time period conveying a rate of repetition of the specified periodic motor speed pattern, said processor being configured for causing the motor driving the pump of the jetting assembly to vary its speed based in part on a) the selected particular first speed; b) the selected particular second speed and c) the selected time period.

* * * * *